US005496245A

United States Patent [19]

Du Verney

[11] Patent Number: 5,496,245

[45] Date of Patent: Mar. 5, 1996

[54] UPPER BODY EXERCISING APPARATUS

[76] Inventor: Carlyle J. Du Verney, 138-11 244th St., Rosedale, N.Y. 11422

[21] Appl. No.: 309,729

[22] Filed: Sep. 21, 1994

[51] Int. Cl.[6] ..... A63B 21/02

[52] U.S. Cl. ..... 482/126; 482/121; 482/122

[58] Field of Search ..... 482/121, 122, 482/125, 126, 124

[56] References Cited

U.S. PATENT DOCUMENTS

| | | | |
|---|---|---|---|
| 2,529,347 | 11/1950 | Mohler et al. | 272/83 |
| 3,349,621 | 10/1967 | Mullen | 482/122 |
| 4,483,533 | 11/1984 | Mangiapane | 272/137 |
| 4,629,186 | 12/1986 | Aldridge | 272/135 |
| 4,681,317 | 7/1987 | Brandell | 482/126 |
| 5,016,874 | 5/1991 | Boardman | 272/137 |
| 5,290,209 | 3/1994 | Wilkinson | 482/121 |

*Primary Examiner*—Lynne A. Reichard
*Attorney, Agent, or Firm*—Richard L. Miller

[57] ABSTRACT

An upper body exercising apparatus comprising a pair of elongated tubular handles pivoted together midway in a scissors-type fashion. A pair of hand grips are affixed to the first ends of the handles. A structure is for biasing the second ends of the handles towards each other. A person can grasp the hand grips by the hands and pull the hand grips away from each other to tone and build up the upper body and arm muscles. The device is also provision to permit alternative exercises by compressing the handles toward each other or by stretching the device between ones hands and feet.

5 Claims, 1 Drawing Sheet

UPPER BODY EXERCISING APPARATUS

BACKGROUND OF THE INVENTION

The instant invention relates generally to exercise devices and more specifically it relates to an upper body exercising apparatus.

Numerous exercise devices have been provided in prior art that are adapted to strengthen various body muscles. For example, U.S. Pat. Nos. 2,529,347 to Mohler et al.; 4,483,533 to Mangiapane; 4,629,186 to Aldridge and 5,016,874 to Boardman all are illustrative of such prior art. While these units may be suitable for the particular purpose to which they address, they would not be as suitable for the purposes of the present invention as heretofore described.

SUMMARY OF THE INVENTION

A primary object of the present invention is to provide an upper body exercising apparatus that will overcome the shortcomings of the prior art devices.

Another object is to provide an upper body exercising apparatus, in which the arms of the apparatus are pulled apart utilizing the stretching of elastic bands extending between the ends of the arms for operating the apparatus.

An additional object is to provide an upper body exercising apparatus that is used for toning and building up the upper body and arm muscles, to keep a person using the apparatus in good physical shape.

A further object is to provide an upper body exercising apparatus that is simple and easy to use.

A still further object is to provide an upper body exercising apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
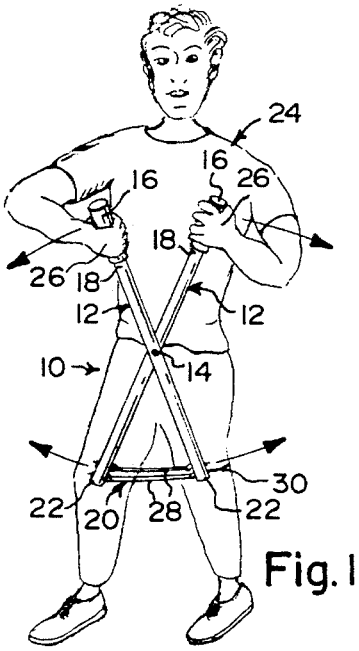
FIG. 1 is a diagrammatic perspective view illustrating a first embodiment of the instant invention in use.
Figure 2:
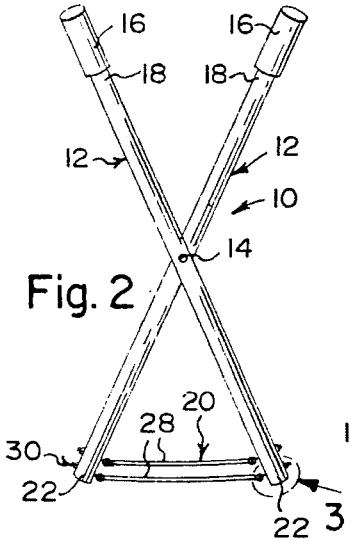
FIG. 2 is an enlarged diagrammatic perspective view of a first embodiment of the instant invention per se.

Turning now descriptively to the drawings, in which similar reference characters denote similar elements throughout the several views, FIGS. 1, 2, 4, 8 and 10 illustrate an upper body exercising apparatus 10 comprising a pair of elongated tubular handles 12 pivoted together midway at 14 in a scissors-type fashion. A pair of hand grips 16 are affixed to the first ends 18 of the handles 12. A structure 20 is for biasing the second ends 22 of the handles 12 towards each other. A person 24 can grasp the hand grips 16 by the hands 26 and pull the hand grips 16 away from each other to tone and build up the upper body and arm muscles.

The biasing structure 20 includes an elastic band 28. An assembly 30 is for securing opposite ends of the elastic band 28 to the second ends 22 of the handles 12. When the hand grips 16 are pulled apart the elastic band 28 will stretch to cause an opposite positive force on the hand grips 16.

Figure 3:
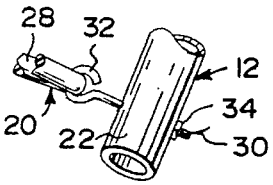
FIG. 3 is a further enlarged perspective view of the area indicated by arrow 3 in FIG. 2.

As shown in FIG. 3, the securing assembly 30 can consist of a pair of eye bolts 32, with each extending transversely through the second end 22 of one handle 12. A pair of nuts 34 are also provided, with each threaded onto one eye bolt 32.

Figure 6:
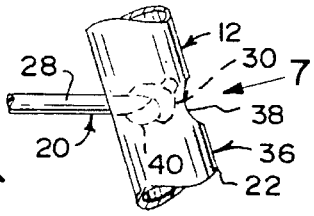
FIG. 6 is a further enlarged perspective view of the area indicated by arrow 6 in FIG. 4.
Figure 7:
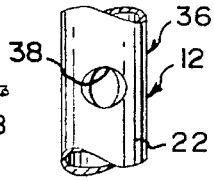
FIG. 7 is an elevational view taken in the direction of arrow 7 in FIG. 6.

As shown in FIGS. 6 and 7, the securing assembly 30 can consist of the handle 12 being a hollow tube 36 and having a transverse aperture 38 adjacent its second end 22. The opposite ends of the elastic band 28 can extend through the transverse apertures 30 and be knotted at 40.

Figure 4:
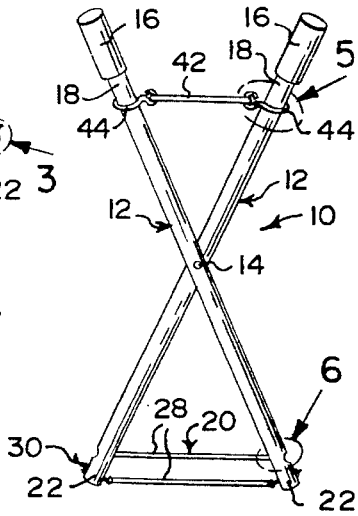
FIG. 4 is an enlarged diagrammatic perspective view of a second embodiment of the instant invention per se.
Figure 5:
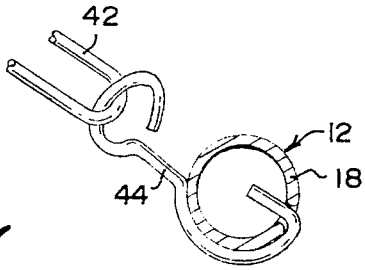
FIG. 5 is a further enlarged perspective view partially in section of the area indicated by arrow 5 in FIG. 4.

In FIGS. 4 and 5, an auxiliary elastic band 42 and a pair of eye hooks 44 are utilized. Each eye hook 44 engages transversely with the first end 18 of one handle 12 to secure opposite ends of the auxiliary elastic band 42 to the first ends 18 of the handles 12. When the hand grips 16 are pulled apart, the auxiliary elastic band 42 will also stretch to cause an increase in the opposite positive force on the hand grips 16.

Figure 8:
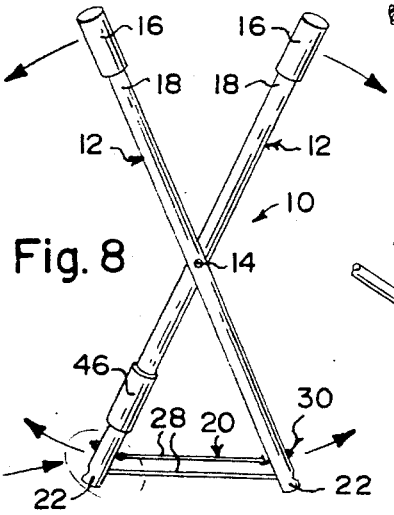
FIG. 8 is an enlarged diagrammatic perspective view of a third embodiment of the instant invention per se.

An auxiliary hand grip 46 in FIGS. 8, is on one handle 12 adjacent the second end 22 thereof. The person 24 can grasp the auxiliary hand grip 46 and the hand grip 16 on the opposite handle 12 to exercise. This grip 46 permits the person to perform an exercise by compressing the device in the direction of the arrows instead of pulling the device apart.

Figure 10:
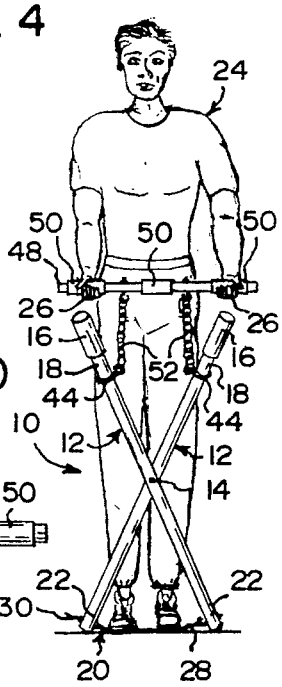
FIG. 10 is a diagrammatic perspective view illustrating the instant invention in use with an auxiliary accessory component.
Figure 9:
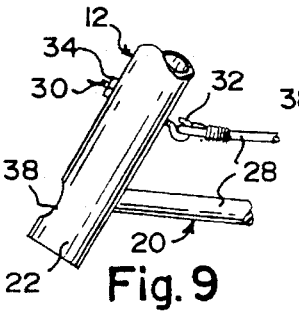
FIG. 9 is an enlarged elevational view of the area indicated by arrow 9 in FIG. 8.
Figure 11:
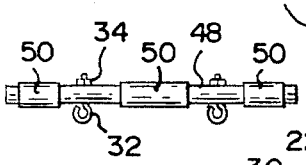
FIG. 11 is a diagrammatic elevational view of the auxiliary accessory component per se.

A cylindrical bar 48 and three hand grips 50 are shown in FIGS. 10 and 11, with two of the hand grips 50 located on opposite ends of the bar 48 and the third hand grip 50 located in the middle of the bar 48. An eye bolt 32 extends transversely through the bar 48 on opposite sides of the third hand grip 50. A nut 34 is threaded onto each eye bolt 32. An eye hook 44 engages transversely with the first end 18 of each handle 12. A pair of additional elastic bands 52 are provided. Opposite ends of each additional elastic band 52 can be secured to one eye bolt 32 and one eye hook 44. A person 24 exercising can stand on the elastic band 28 between the second ends 22 of the handles 12, grasp the two hand grips 50 on the bar 48 and pull up to exercise.

OPERATION OF THE INVENTION

To use the upper body exercising apparatus 10, a person 24 simply grasps the hand grips 16 by the hands 26 and pull them away from each other, as shown in FIG. 1. The person 24 can grasp the auxiliary hand grip 46 and the hand grip 16 on the opposite handle 12 and press them towards each other, as in FIG. 8. The person 24 can grasp the hand grips 50 on the bar 48 in FIG. 10 and pull up to stretch the additional elastic bands 52, as shown in FIG. 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An upper body exercising apparatus comprising:

a) a pair of elongated tubular handles each having a first end, a second end, a center portion, pivoted together in the center portion thereof;

b) a pair of hand grips one of said hand grips affixed to the first end of one of said handles and the other of said hand grips affixed to the other of said handles;

c) means for biasing the second ends of said handles towards each other, wherein a person can grasp said hand grips by the hands and pull said hand grips away from each other to tone and build up the upper body and arm muscles, said biasing means includes an elastic band, and means for securing opposite ends of said elastic band to the second ends of said handles, wherein when said hand grips are pulled apart said elastic band will stretch to cause an opposite positive force on said hand grips;

d) a tubular cylindrical bar;

e) three hand grips, two of said hand grips located on opposite ends of said bar and said third hand grip located in the middle of said bar;

f) a pair of eye bolts, each extending transversely through said bar on opposite sides of said third hand grip;

g) a pair of nuts, each threaded onto one said eye bolt;

h) a pair of eye hooks, each engaging transversely with the first end of one said handle; and i) a pair of additional elastic bands, opposite ends of each said additional elastic band can be secured to one said eye bolt and one said eye hook, wherein a person exercising can stand on said elastic band between the second ends of said handles, grasp said two hand grips on said bar and pull up to exercise.

2. An upper body exercising apparatus as recited in claim 1, wherein said securing means includes:

a) a pair of eye bolts, each extending transversely through the second end of one said handle; and b) a pair of nuts, each threaded onto one said eye bolt.

3. An upper body exercising apparatus as recited in claim 1, wherein each said handle is hollow and has a transverse aperture therethrough adjacent its second end, said securing means includes the opposite ends of said elastic band extending through said transverse apertures and knotted.

4. An upper body exercising apparatus as recited in claim 1, further including:

a) an auxiliary elastic band; and b) a pair of eye hooks, each engaging transversely with the first end of one said handle to secure opposite ends of said auxiliary elastic band to the first ends of said handles, wherein when said hand grips are pulled apart, said auxiliary elastic band will also stretch to cause an increase in the opposite positive force on the hand grips.

5. An upper body exercising apparatus as recited in claim 1, further including an auxiliary hand grip on one said handle adjacent the second end thereof, wherein the person can grasp said auxiliary hand grip and said hand grip on said opposite handle to exercise.

* * * * *